US006117537A

United States Patent [19]

Butters et al.

[11] Patent Number: 6,117,537

[45] Date of Patent: Sep. 12, 2000

[54] INKABLE SHEET

[75] Inventors: Alan Butters, Suffolk; Roger N Barker; John A Pope, both of Essex, all of United Kingdom

[73] Assignee: Imperial Chemical Industries PLC, London, United Kingdom

[21] Appl. No.: 07/087,973

[22] Filed: Aug. 17, 1987

Related U.S. Application Data

[63] Continuation of application No. 06/714,674, Mar. 21, 1985, abandoned.

[30] Foreign Application Priority Data

Mar. 29, 1984 [GB] United Kingdom ..... 8408079

[51] Int. Cl.[7] ..... B41M 5/00

[52] U.S. Cl. ..... 428/304.4; 428/195; 428/332; 428/480

[58] Field of Search ..... 427/261, 288; 428/195, 207, 211, 304.4, 318.4, 537.5, 332, 480; 346/135.1

[56] References Cited

U.S. PATENT DOCUMENTS

| | | | |
|---|---|---|---|
| 4,269,891 | 5/1981 | Minagawa | 428/207 |
| 4,446,174 | 5/1984 | Maekawa et al. | 428/211 |
| 4,460,637 | 7/1984 | Miyamoto et al. | 428/207 |
| 4,478,910 | 10/1984 | Oshima et al. | 428/537.5 |

*Primary Examiner*—Bruce H. Hess
*Attorney, Agent, or Firm*—Pillsbury Madison & Sutro LLP

[57] ABSTRACT

An inkable sheet suitable for use as an ink jet recording sheet comprises a non-porous thermoplastics polymeric film substrate having on a surface thereof a porous, ink-absorbent, resin layer. The porous layer which comprises voids capable of absorbing and retaining an aqueous-organic ink-solvent medium by capillary action, may comprise a hydrophobic resin, a hydrophilic resin or a blend thereof, and may be bonded to a substrate, such as a film of polyethylene terephthalate, by an intermediate adhesive resin layer. The sheet is particularly suitable in the production of an imaged transparency for use in a transmission mode.

10 Claims, 1 Drawing Sheet

INKABLE SHEET

This is a continuation of application Ser. No. 06/714,674, filed Mar. 21, 1985, which was abandoned upon the filing hereof.

BACKGROUND OF THE INVENTION (a) Technical Field of Invention

This invention relates to an inkable sheet, and, in particular, to a sheet suitable for use with an ink jet printer.

(b) Background of the Art

Ink jet printing is already established as a technique for printing variable information such as address labels, multicolour graphics, and the like. A simple form of ink jet printer comprises a capillary tube coupled to an ink reservoir and a piezo-electric element which, on application of a voltage pulse, ejects an ink droplet from the capillary tube at high velocity (e.g. up to 20 $ms^{-1}$) onto an ink-receptive sheet. Movement of the ink jet may be computer controlled, and new characters may therefore be formed and printed at electronic speeds. To derive advantage from this high speed operating capability requires the use of an ink-receptive sheet which will quickly absorb the high velocity ink droplet without blotting or bleeding. Although plastic sheets may be employed, these generally tend to exhibit inferior ink absorption and retention characteristics. In particular, drying of an applied ink pattern is slow, and immediate handling of a freshly imaged sheet is therefore prevented.

(c) The Prior Art

Various recording sheets have been proposed for use with ink jet printers. For example, British patent specification GB 2050866-A discloses an ink-jet recording sheet comprising a layer of a water-soluble coating polymer disposed on a support having a water absorptivity of not more than 30 $gm^{-2}$ (JIS P8140). The support, which may be of paper, cloth, plastic film, metal sheet, wood board or glass sheet, should be sized, if necessary, to provide the specified water absorptivity level to prevent penetration of the water-soluble coating polymer into the support. The characteristic feature of the sheet is that the layer of water-soluble polymer, which desirably has a high viscosity, dissolves or swells in the water of a subsequently applied aqueous ink to increase the viscosity of the ink. Although such behaviour is said to provide an image of high density, high resolution and good colour reproduction without causing ink overflow, mixing or flying, a pattern applied to the sheet using an aqueous organic solvent-based ink is relatively slow to dry.

British patent specification GB 2116880-A relates to a material, used to bear writing or printing, comprising a substrate having a coating layer which is divided by micro-cracks of irregular form into lamellae. The width of each micro-crack is usually several microns, whereby the solvent medium of a subsequently applied ink passes through the micro-cracks and is quickly absorbed into the substrate which comprises a porous, liquid-absorbing material, such as paper. The dimensions of the micro-cracks are such that the product is opaque and therefore unsuitable for use in the production of transparencies for use in an overhead projector. Furthermore, the requirement for the solvent medium of the ink to pass through the micro-cracked structure into the porous substrate precludes the provision of an intermediate adhesive layer to promote adhesion between the substrate and coating layer.

We have now devised an inkable sheet which is particularly suitable as an ink jet recording sheet for use with an ink jet printer.

SUMMARY OF THE INVENTION

Accordingly, the present invention provides an inkable sheet comprising a self-supporting non-porous thermoplastics polymeric film substrate having on a surface thereof a porous, ink-absorbent, resin layer.

DETAILED DESCRIPTION AND PREFERRED EMBODIMENTS OF THE INVENTION

In one embodiment of the invention, an inkable sheet additionally comprises an intermediate adhesive layer between the substrate and ink-absorbent layer. The adhesive layer may be deposited directly onto the substrate or may be bonded thereto by a priming layer.

By a "self-supporting film" is meant a film capable of independent existence in the absence of a supporting substrate.

By a "non-porous" substrate is meant a substrate incapable of absorbing an aqueous-organic ink-solvent medium other than by molecular diffusion of the medium into the substrate.

By a "porous" resin layer is meant a resin layer comprising voids , such as—fissures, cracks, pores, open cells, or the like, capable of absorbing and retaining an aqueous-organic ink-solvent medium by capillary action.

The porous ink-absorbent layer permits rapid drying of an applied inked pattern, and is desirably such that an aqueous-diethylene glycol (50:50 w/w) based ink, or similar composition, applied to the surface of a sheet from an ink jet printer will resist off-setting when the inked surface is placed in contact with the surface of a paper sheet within 50 seconds, and preferably within 45 seconds, of application of the ink. Desirably, the applied ink should be absorbed by the absorbent layer to an extent such that smudging does not occur on rubbing with a finger within 45 seconds, and preferably within 30 seconds of application of the ink.

The ink-absorbent layer conveniently comprises any hydrophobic or hydrophilic resin, or a blend of resins, which can be coated onto the substrate to yield an absorbent layer having a degree of porosity and pore size which will confer the desired ink-absorption characteristics. If a hydrophobic resin is employed, a surfactant may conveniently be incorporated therewith to ensure adequate wetting of the pores by the subsequently applied ink.

An inkable sheet according to the invention is of particular utility in the production of an imaged transparency for viewing in a transmission mode, as for example in association with an overhead projector in which a light source is positioned behind a sheet bearing an inked image and the image is observed from the image side by light transmitted through the sheet. The dimensions of the voids in the porous resin layer should therefore be such that the non-inked porous layer is initially transparent, i.e. substantially non-light-scattering, or can be rendered transparent by absorbing an ink medium—for example, in the region(s) to which an inked pattern has been applied by an ink jet printer to create the desired image. A non-inked porous layer therefore will generally comprise voids, such as fissures, cracks, pores, open cells, or the like, having a width or diameter in a range of from 0.001 to 5.0 microns, although it is preferred that the non-inked porous layer should be inherently transparent and non-light-scattering and therefore comprise voids of width or diameter from 0.001 to 1.0, preferably from 0.001 to 0.75, and, particularly preferably from 0.01 to 0.05, microns. The aspect ratio (i.e. length:width) of the voids may vary over a wide range, but is typically from 1 to 1000, for example— from 4 to 400, and especially from 20 to 100. A porous layer having voids of width or diameter of from about 1.0 to 5.0 microns will be substantially light-scattering, so that the resultant sheet is of an opaque appearance. However, ink deposited thereon from a jet printer will become absorbed within the relatively small voids to form a relatively transparent pattern on the opaque surface whereby, in a transmission mode, for example—in association with an overhead projector, the inked pattern may be viewed as a coloured image against a dark background. Elimination of glare in the viewing situation is thereby achieved.

A porous ink-absorbent resin layer may be prepared by a variety of methods. Thus, a film substrate may be coated with a formulation comprising a colloidal dispersion in a volatile carrier medium—for example, a coacervate of a polyacid and a polybasic material. Alternatively, a blend of incompatible polymers may be deposited from a mutual solvent. In another method, a polymer may be deposited on a substrate from a blend of solvents such that the least volatile and slower evaporating solvent has poor solvency for the absorbent resin. Step-wise drying of a deposited polymer layer may also be employed to yield the desired porous structure.

It will be apparent that any resin capable of forming a porous absorbent layer on a film substrate may be employed in the production of a sheet according to the invention. Suitable resins include cellulosics, such as nitrocellulose, ethylcellulose and hydroxyethylcellulose; gelatins; vinyls, such as polyvinylacetate, polyvinylchloride, and copolymers of vinyl chloride and vinyl acetate; acrylics, such as polyacrylic acid; and polyvinylpyrrolidones. A typical blend of resins, which may be employed to yield an opaque coating on a sheet, comprises polyvinylpyrrolidone, nitro cellulose and cellulose acetate phthalate. A transparent ink-absorbent layer preferably comprises a cellulosic resin and, in particular, a hydroxyethylcellulose. The layer is conveniently applied to the substrate by a conventional coating technique—for example, by deposition from a solution or dispersion in a volatile medium, such as an aqueous or organic solvent medium, a preferred coating medium comprising an aqueous-methanolic suspension of a hydroxyethylcellulose.

Drying of the applied ink-absorbent layer may be effected by conventional drying techniques. In particular, to confer porosity, drying may be effected by a step-wise technique—for example, by initially suspending the coated substrate in a hot air oven maintained at a temperature of from about 60 to 100° C., and subsequently heating the coated substrate to a higher temperature for example, about 120° C., until the desired porosity is developed.

The thickness of the dry ink-absorbent layer may vary over a wide range but is conveniently within a range of from 5 to 25 microns, and preferably from 8 to 13, for example 10, microns.

A feature of such absorbent coatings is the flatness of the resultant, single-side coated sheet—as evidenced by the absence of edge lift-off when the sheet is placed on a flat surface—such as a table top.

If desired, the ink-absorbent layer may additionally comprise a particulate filler to improve the handling characteristics of the sheet. Suitable fillers include silica, desirably of a particle size not exceeding 20, and preferably less than 12, for example 8, microns. The amount of filler employed will be dictated by the desired characteristics of the sheet but will generally be low to ensure that the optical characteristics (such as haze) of the sheet remain unimpaired. Typical filler loadings are of the order of less than 0.5, and preferably from 0.1 to 0.2, per cent by weight of the resin component.

A non-porous substrate (primed, if desired) on which the ink-absorbent layer is deposited may comprise any polymeric material, capable of forming a self supporting opaque or, preferably, transparent film or sheet. Suitable polymeric materials include cellulose esters, e.g. cellulose acetate, polystyrene, polyamides, polymers and copolymers of vinyl chloride, polymers and copolymers of olefines, e.g. polypropylene, polysulphones, polycarbonates and particularly linear polyesters which may be obtained by condensing one or more dicarboxylic acids or their lower alkyl (up to 6 carbon atoms) diesters, e.g. terephthalic acid, isophthalic acid, phthalic acid, 2,5-, 2,6- and 2,7-napthalene dicarboxylic acid, succinic acid, sebacic acid, adipic acid, azelaic acid, diphenyldicarboxylic acid and hexahydroterephthalic acid or bis-p-carboxyl phenoxy ethane (optionally with a monocarboxylic acid such as pivalic acid) with one or more glycols, e.g. ethylene glycol, 1,3-propanediol, 1,4-butanediol, neopentyl glycol and 1,4-cyclohexanedimethanol. A biaxially oriented and heat-set film of polyethylene terephthalate is particularly useful as a substrate for the production of a sheet according to the invention and may be produced by any of the processes known in the art, e.g. as described in British patent specification 838 708.

The polymer substrate is suitably of a thickness from 25 to 300, particularly from 50 to 175 and especially from 75 to 125 microns.

An adhesive layer suitable for inclusion, if desired, between the substrate and ink-absorbent layer may comprise a polyester resin, but preferably comprises at least one-thermoplastics resin component and a tackifier component therefor. A range of thermoplastics resins may be used in formulating the adhesive layer, with the proviso that preferably they are light-transmitting. Elastomeric thermoplastics such as low molecular weight polyethylene, amorphous polypropylene, ethylene-vinyl acetate copolymers or ethylene-ethyl acrylate copolymers are suitable representatives of this component of the adhesive coating layer. Preferred elastomeric thermoplastics resins for this application are SBS and SIS copolymers (styrene-butadiene-styrene and styrene-isoprene-styrene block copolymers) the SBS copolymers being found generally to provide more readily the desired properties in the adhesive coating.

Tackifiers suitable for use in formulating the adhesive layer include, rosin esters, hydrogenated rosin and hydrogenated rosin esters, polyterpene resins, aromatic e.g. coumarone-indene resins, mixed aromatic/aliphatic resins e.g. copolymers of $C_5$ conjugated dienes and styrene or alpha-methyl styrene or vinyltoluene and aliphatic resins derived from mixtures of $C_5$ mono- and di-olefines. Although the tackifying properties of any given tackifier vary from thermoplastics resin to thermoplastics resin the effectiveness tends to decrease in the order of the tackifiers listed above, i.e. rosin is excellent whereas $C_5$ resins are less effective. The nature of the thermoplastics resin does however play a large part. For example, the aliphatic resins are more effective in SIS than in SBS thermoplastics.

The adhesive layer may include any other additive conventionally employed in the polymeric films art, including, for example, waxes, slip and anti-blocking agents, antioxidants and stabilisers and, in particular, a particulate filler, such as alumina or silica, having a particle size of less than about 20 microns, and preferably from 1 to 10 microns, to facilitate handling of the adhesive-coated substrate on conventional roller equipment.

The adhesive layer conveniently comprises from 30 to 70%, preferably from 35 to 60%, by weight thermoplastics resin, from 70 to 30%, preferably from 40 to 65% by weight tackifier(s) and up to 5%, preferably up to 3%, by weight each of the other additive(s).

The thickness of the adhesive layer is desirably less than 10, and preferably less than 1.5 microns.

The adhesive layer may be applied to the substrate by deposition from a common organic solvent e.g. trichlorethylene, acetone or methylethyl ketone.

Alternatively, a surface of the substrate may first be treated with a priming medium. Creation of a priming layer is conveniently effected by treating the surface of the polymer substrate with an agent known in the art to have a solvent or swelling action on the substrate polymer. Examples of such agents, which are particularly suitable for the treatment of a polyester substrate, include a halogenated phenol dissolved in a common organic solvent e.g. a solution of p-chloro-meta-cresol, 2,4-dichlorophenol, 2,4,5, or 2,4, 6-trichlorophenol or 4-chlororesorcinol in acetone or methanol. In addition, and preferably, the priming solution may contain a partially hydrolysed vinyl chloride-vinyl acetate copolymer. Such a copolymr conveniently contains from 60 to 98 per cent of vinyl chloride, and from 0.5 to 3% of hydroxyl units, by weight of the copolymer. The molecular weight (number average) of the copolymer is conveniently in a range of from 10,000 to 30,000, and preferably from 16,500 to 25,000.

The priming agent is suitably applied at a concentration level which will yield a priming layer having a relatively thin dry coat thickness—for example, generally less than 2 microns, and preferably, less than 1 micron.

An alternative adhesive layer, suitable for deposition onto a phenolic primer layer of the aforementioned kind, conveniently comprises a partial ester formed from polyvinyl alcohol and monochloroacetic acid.

An inkable sheet according to the invention is particularly suitable for use in the preparation of inked transparencies for use in a transmission mode, for example—with an overhead projector. Retention in the porous absorbent layer of the solvent medium of an applied ink ensures rapid drying of the ink, and facilitates immediate use of the imaged sheet.

BRIEF DESCRIPTION OF THE DRAWINGS

The invention is illustrated by reference to the accompanying drawings in which.

Figure 1:
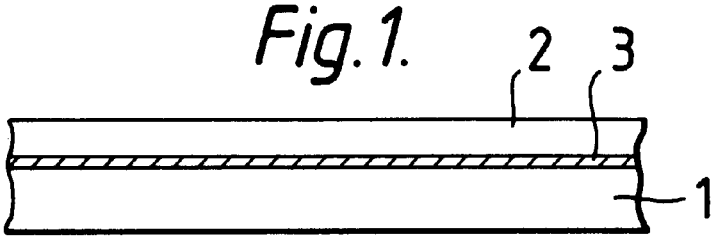
FIG. 1 is a schematic elevation (not to scale) of a portion of an inkable sheet comprising a non-porous substrate 1 to one surface of which a porous, ink-absorbent layer 2 is bonded by an intermediate layer 3 of an adhesive resin.
Figure 2:
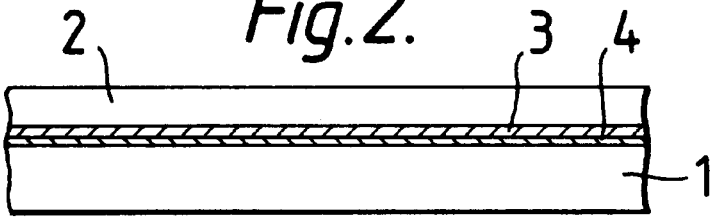
FIG. 2 is a fragmentary schematic elevation of a similar sheet in which an additional layer 4 of a priming medium is provided at the interface between substrate 1 and adhesive layer 3.
Figure 3:
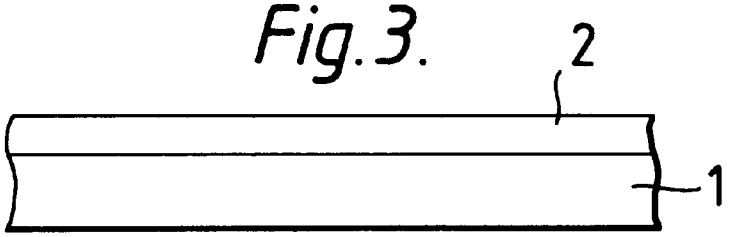
FIG. 3 is a fragmentary schematic elevation of a similar sheet in which an absorbent, porous layer 2 is bonded directly to a surface of an unprimed, non-porous substrate 1.
Figure 4:
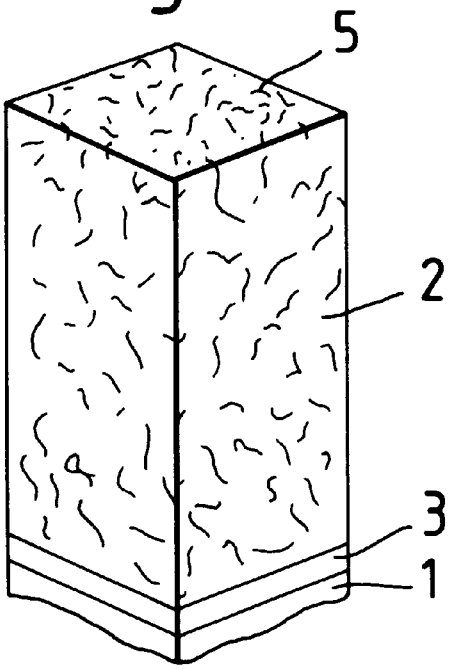
FIG. 4 is a schematic, magnified, perspective view of an element of the sheet of FIG. 1. Based on examination by scanning electron microscope, the ink-absorbent layer 2 of about 10 microns thickness comprises an array of fissure-like voids 5. The aspect ratio of these voids varies, but a typical void 5 is approximately 0.4 microns long and 0.05 microns wide, i.e. an aspect ratio of 8.

The invention is further illustrated by reference to the following Examples.

EXAMPLE 1

One surface of a biaxially oriented, uncoated, polyethylene terephthalate film substrate of about 100 microns thickness was treated with an adhesive resin medium comprising a solution in trichloroethylene of CARIFLEX TR 1100 (2.0% weight/vol) and ZONATAC 105(2.0% weight/vol) resins. The resin solution also contained 0.5% by weight of the resins of GASIL HP 34. CARIFLEX TR 1100 is a styrene-butadiene-styrene block copolymer resin; ZONATAC 105 is a polyterpene resin; GASIL HP34 is a particulate silica filler.

The treated substrate was then dried in a hot air oven at 60° C. to leave an adhesive layer of about 1 micron thickness on the substrate.

The dry adhesive-coated-sheet was then coated with an aqueous-methanol (15:85 w/w) solution of a hydroxy ethyl cellulose resin containing about 0.2 per cent, by weight of the resin, of silica of mean particle size about 8 microns. The coated sheet was then dried in an air oven initially at a temperature of 100° C. for 30 seconds,and then at a temperature of 120° C. for 5 minutes, to leave an ink-absorbent porous coating of some 10 microns thickness.

Examination of the porous coating layer by scanning electron microscope revealed a pattern of fissure-like voids of average width in a range of from 0.01 to 0.05 microns extending over the surface and into the layer.

An aqueous-diethylene glycol (50:50 w/w)-based ink applied to the ink-absorbent layer from an ink jet printer was resistant to rubbing by a finger within from 15 to 30 seconds of the application, and was resistant to off-setting in contact with a Caxton copier paper sheet within 45 seconds of the application.

EXAMPLE 2

This is a comparative Example not according to the invention. The procedure of Example 1 was repeated save that the ink-absorbent layer was a hydroxypropylmethyl cellulose resin, and was dried to yield a non-porous resin layer. The resultant sheet was susceptible to blotting for up to 5 minutes after application of the ink.

EXAMPLE 3

One surface of a commercially available, untreated, cast cellulose triacetate film was directly coated (i.e. no intermediate adhesive resin layer) with an aqueous-methanol (15.85 w/w) solution of a hydroxy ethyl cellulose resin containing about 0.2 per cent, by weight of the resin, of silica of mean particle size about 8 microns. The coated sheet was then dried in an air oven initially at a temperature of 100° C. for 30 seconds, and then at a temperature of 120° C. for 5 minutes, to leave an ink-absorbent porous coating of some 10 microns thickness, exhibiting fissure-like voids of the kind observed in Example 1.

An aqueous-diethylene glycol (50:50 w/w) based ink applied to the ink-absorbent layer from an ink jet printer was resistant to rubbing by a finger within from 15 to 30 seconds of the application, and was resistant to off-setting in contact with a Caxton copier paper sheet within 45 seconds of the application.

When imaged with an inked pattern applied by an ink jet printer the sheet performed satisfactorily as a transparency for use with an overhead projector.

EXAMPLE 4

One surface of a biaxially oriented, uncoated, polyethylene terephthalate film substrate was treated with an adhesive resin medium comprising a solution in methyl ethyl ketone of a soluble polyester resin (Du Pont 49001) (4.0% weight/vol). The resin solution also contained 0.5% by weight of the resin of GASIL HP 34. GASIL HP34 is a particulate silica filler.

The treated substrate was then dried in a hot air oven, coated with an aqueous-methanol (15:85 w/w) solution of a hydroxy ethyl cellulose resin containing about 0.2 per cent, by weight of the resin, of silica, and step-wise dried, as described in Example 1.

An aqueous-diethylene glycol (50:50 w/w)-based ink applied to the ink-absorbent layer from an ink jet printer was resistant to rubbing by a finger within from 15 to 30 seconds of the application, and was resistant to off-setting in contact with a Caxton copier paper sheet within 45 seconds of the application.

When imaged with an inked pattern applied by an ink jet printer the sheet performed satisfactorily as a transparecy for use with an overhead projector.

EXAMPLE 5

The procedure of Example 4 was repeated save that the hydroxyethyl cellulose coating did not contain a silica filler.

The product behaved similarly to that of Example 4.

We claim:

1. A transparent inkable sheet comprising a self-supporting non-porous thermoplastics polymeric film substrate having on a surface thereof a porous, ink-absorbent, resin layer, said porous, ink-absorbent resin layer consisting essentially of a resin layer having voids capable of absorbing and retaining an aqueous-organic ink-solvent medium by capillary action.

2. An inkable sheet according to claim 1 wherein the voids have a width or diameter of from 0.001 to 5.0 microns.

3. An inkable sheet according to claim 2 wherein the voids have a width or diameter of from 0.001 to 1.0 micron.

4. An inkable sheet according to claim 1 wherein the porous layer comprises a hydrophobic resin, or a hydrophilic resin, or a blend of two or more hydrophobic and hydrophilic resins, whereby the porosity of the porous layer is such that an aqueous-diethylene glycol (50:50 w/w)-based ink applied to the porous layer from an ink jet printer will resist off-setting when placed in contact with a paper sheet within 50 seconds of application of the ink.

5. An inkable sheet according to claim 1 wherein the porous layer comprises a cellulosic resin.

6. An inkable sheet according to claim 1 wherein the substrate comprises a biaxially oriented polyethylene terephthalate film.

7. An inkable sheet according to claim 1 additionally comprising an intermediate adhesive layer between the substrate and the ink-absorbent layer.

8. An inkable sheet according to claim 1 wherein the adhesive layer comprises an elastomeric thermoplastics resin and a tackifier therefor.

9. An imaged transparency for use in a transmission mode comprising a sheet according to claim 1 having an inked pattern applied to the porous resin layer by an ink jet printing technique.

10. An inkable sheet according to claim 1, wherein the porous ink-absorbent layer is such that an aqueous-diethylene glycol (50:50 w/w) based ink applied to the surface of the sheet from an ink jet printer will resist off-setting when the inked surface is placed in contact with the surface of a paper sheet within 50 seconds of application of the ink, the applied ink being absorbed by the absorbent layer to an extent such that smudging does not occur on rubbing with a finger within 45 seconds of application of the ink.

* * * * *